US006615779B2

(12) United States Patent
Mae et al.

(10) Patent No.: US 6,615,779 B2
(45) Date of Patent: Sep. 9, 2003

(54) CONTROL OF AN ELECTROMAGNETIC STEERING VALVE OF A CAMSHAFT PHASER

(75) Inventors: Yosuke Mae, Yokohama (JP); Tetsurou Murata, Yokohama (JP); Motokata Ishihara, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/088,472

(22) PCT Filed: Jun. 28, 2001

(86) PCT No.: PCT/JP01/05619

§ 371 (c)(1),
(2), (4) Date: Mar. 20, 2002

(87) PCT Pub. No.: WO02/08578

PCT Pub. Date: Jan. 31, 2002

(65) Prior Publication Data

US 2002/0134335 A1 Sep. 26, 2002

(30) Foreign Application Priority Data

Jul. 21, 2000 (JP) ..... 2000-220391

(51) Int. Cl.[7] ..... F01L 1/34

(52) U.S. Cl. ..... 123/90.17; 123/90.12; 123/90.16; 123/90.14; 123/90.15

(58) Field of Search ..... 123/90.12, 90.13, 123/90.14, 90.15, 90.16, 90.17

(56) References Cited

U.S. PATENT DOCUMENTS 4,106,446 A * 8/1978 Yamada et al. ..... 123/90.13
5,003,937 A * 4/1991 Matsumoto et al. ..... 123/90.12
6,006,707 A 12/1999 Ito
6,105,543 A 8/2000 Ogawa
2001/0020458 A1 9/2001 Mikame

FOREIGN PATENT DOCUMENTS

| | | | |
|---|---|---|---|
| DE | 19745908 | A1 | 4/1999 |
| DE | 19860025 | A1 | 7/1999 |
| JP | 7180514 | A | 7/1995 |
| JP | 8028219 | A | 1/1996 |
| JP | 9195805 | A | 7/1997 |
| JP | 9195808 | A | 7/1997 |
| JP | 2000303864 | A | 10/2000 |

* cited by examiner

*Primary Examiner*—Thomas Denion
*Assistant Examiner*—Jaime Corrigan
(74) *Attorney, Agent, or Firm*—Shinjyu Global IP Counselors, LLP

(57) ABSTRACT

The movable valve apparatus includes the movable valve mechanism, the hydraulic pressure control valve, and the controller. The movable valve mechanism changes the opening/closing timing of an air intake or exhaust valve depending on the supplied hydraulic pressure of the working fluid. The hydraulic pressure control valve adjusts the supplied hydraulic pressure depending on the working condition of the spool. The controller controls the solenoid that drives the spool. When it is determined that the spool is in the returning state, in which the spool starts moving toward the initial position, the foreign object removal operation is executed. During the foreign removal operation, the spool temporarily reciprocates in order to remove foreign objects in the hydraulic pressure control valve.

16 Claims, 5 Drawing Sheets

CONTROL OF AN ELECTROMAGNETIC STEERING VALVE OF A CAMSHAFT PHASER

This application is the national phase under 35 U.S.C. §371 of International Application No. PCT JP01/05619, which was filed on Jun. 28, 2001 and published in English on Jan. 31, 2002.

BACKGROUND OF THE INVENTION

1. Technical Field

The present invention generally relates to a movable valve apparatus for an internal combustion engine. More specifically, the present invention relates to a movable valve apparatus for an internal combustion engine having a movable valve mechanism that changes the working condition of the air intake valve or exhaust valve depending on a supplied hydraulic pressure of the working fluid.

2. Description of Related Art

Japanese Laid-Open Patent Application H8-28219 discloses a movable valve mechanism that changes an opening/closing timing of an air intake or exhaust valve according to a supplied hydraulic pressure of working fluid. The hydraulic pressure supplied to this movable valve mechanism is adjusted according to a working condition of a spool that reciprocates within a sleeve of a hydraulic pressure control valve. The hydraulic pressure control valve includes a return spring that always biases the spool to a minus side, and a solenoid that drives the spool to the other side in response to an input of a control signal.

When a foreign object (impurity) such as chips that entered the working fluid during chip processing becomes jammed inside the hydraulic pressure control valve, particularly at a partition portion between a drain port formed in the sleeve and the spool, so-called valve lock may occur. Therefore, in the above-mentioned patent application, when it is determined that a foreign object is jammed, more specifically when an actual cam phase detected by a cam angle sensor and a target cam phase obtained by a separate calculation differ by more than a predetermined value, a foreign object removal operation is executed, during which the spool reciprocates temporarily.

In a valve timing adjustment apparatus disclosed in Japanese Laid-Open Patent Application H9-195805, the foreign object removal operation is executed when the hydraulic pressure control valve keeps an opening that is below a predetermined opening for longer than a predetermined period of time, when the engine is started or stopped, or while the engine is idling.

In view of the above, there exists a need for an improved movable valve apparatus for an internal combustion engine. This invention addresses this need for improvement in the prior art as well as other needs, which will become apparent to those skilled in the art from this disclosure.

SUMMARY OF THE INVENTION

It has been determined from the disclosure of Japanese Laid-Open Patent Application H8-28219, which proposes executing the foreign object removal operation when a foreign object is actually jammed, that the targeted valve timing may not be achieved temporarily due to the foreign object removal operation, depending on the working condition of the spool at the time the foreign object removal operation is executed. Accordingly, malfunctioning such as insufficient acceleration and unstable idling may result.

Also, it has also been determined from Japanese Laid-Open Patent Application H8-28219 that the determination of a foreign object being jammed is made based on a phase difference in the cam phases. However, if this determination is made strictly, it may be mistakenly determined an occurrence of jamming even when it has not occurred. In that case, the spool reciprocates unnecessarily, reducing the responsiveness. On the other hand, when the determination is made leniently, it may be wrongfully determined that no jamming is occurring even when a foreign object is actually jammed. In that case, the working performance of the engine may be obstructed. In other words, lowering of engine output or engine stop may result.

On the other hand, in the Japanese Laid-Open Patent Application H9-195805, when the foreign object removal operation is executed in situations where a foreign object is likely to be jammed, the stability of the engine may be adversely affected if, for instance, the foreign object is jammed while the spool is returning to the initial position. Accordingly, further improvement is desired. The present invention is conceived in view of these problems.

An example of a movable valve mechanism is described in Japanese Laid-Open Patent Application H7-180514. This Japanese application describes a movable valve mechanism in which a phase of a camshaft of the air intake valve or the exhaust valve is changed relative to a crankshaft by a controller. The controller of this application operates a cam switching mechanism that switches a plurality of cams, and a mechanism that changes a working angle of the air intake valve (valve lift amount). In the aforementioned controller, an engine control unit has a memory or CPU that is preferably utilized to stores and executes various engine controls such as the aforementioned driving control of the spool, various controls of fuel injection period, fuel injection amount, and igniting timing.

Preferably, a port for supplying hydraulic pressure to the movable valve mechanism, a port for introducing the hydraulic pressure from the hydraulic pressure source, and a plurality of ports for draining are formed in the sleeve of the aforementioned hydraulic pressure control valve. These ports are selectively closed and opened based on the position of the spool, in order to adjust the supply of hydraulic pressure to the movable valve mechanism.

In this case, when it is determined that a foreign object is jammed while the spool is returning to the initial position, the spool cannot return to the initial position. In that case, the working condition (opening/closing timing) of the air intake or exhaust valve cannot return to the initial state. Accordingly, the engine may not idle or start properly, or the engine may stop. Therefore, the stability of the engine is dramatically lessened.

In accordance with one aspect of the present invention, a movable valve apparatus is provided for adjusting an air control valve of an internal combustion engine. The movable valve apparatus basically comprises a movable valve mechanism, a hydraulic pressure control valve and a controller. The movable valve mechanism is operatively controlled by hydraulic pressure of a working fluid to adjusting the air control valve. The hydraulic pressure control valve is operatively coupled to the movable valve mechanism to adjust the hydraulic pressure of the working fluid supplied to the movable valve mechanism. The hydraulic pressure control valve includes a spool reciprocally coupled within a sleeve to control the hydraulic pressure of the working fluid supplied to the movable valve mechanism. The controller is operatively coupled to the hydraulic pressure control valve to drive and control the spool within the sleeve. The controller is configured to execute a foreign object removal operation upon the controller determining that the spool is in a returning state in which the spool starts moving toward an initial position. The spool is temporarily reciprocated by the controller to remove foreign objects inside the hydraulic pressure control valve during the foreign object removal operation.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following description of the embodiments of the present invention is provided for illustration only, and not for the purpose of limiting the invention as defined by the appended claims and their equivalents.

Figure 1:
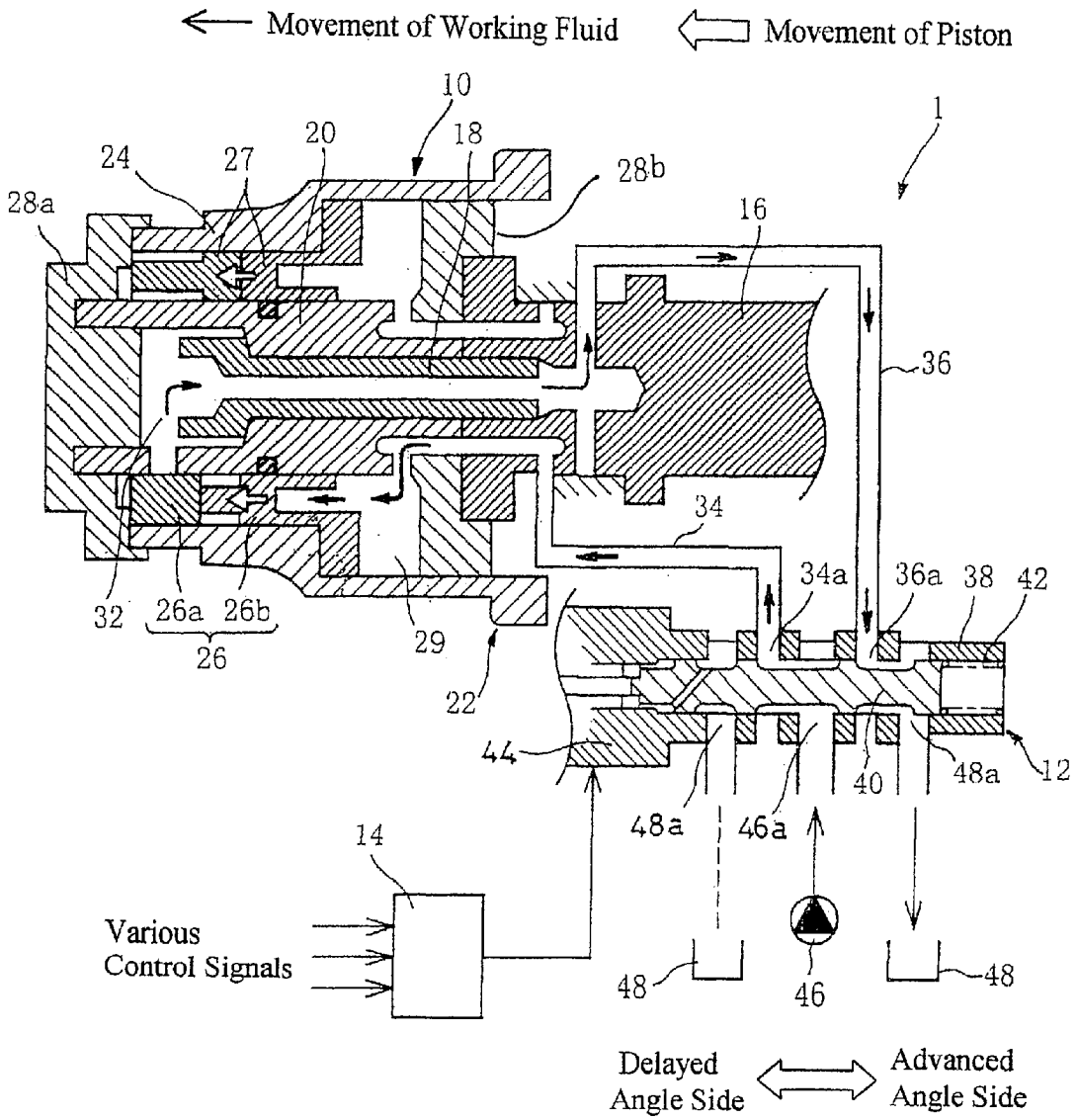
FIG. 1 is a cross sectional view of the movable valve apparatus for internal combustion engine in accordance with the embodiment of the present invention, corresponding to a state in which the spool is maintained in the initial position.
Figure 2:
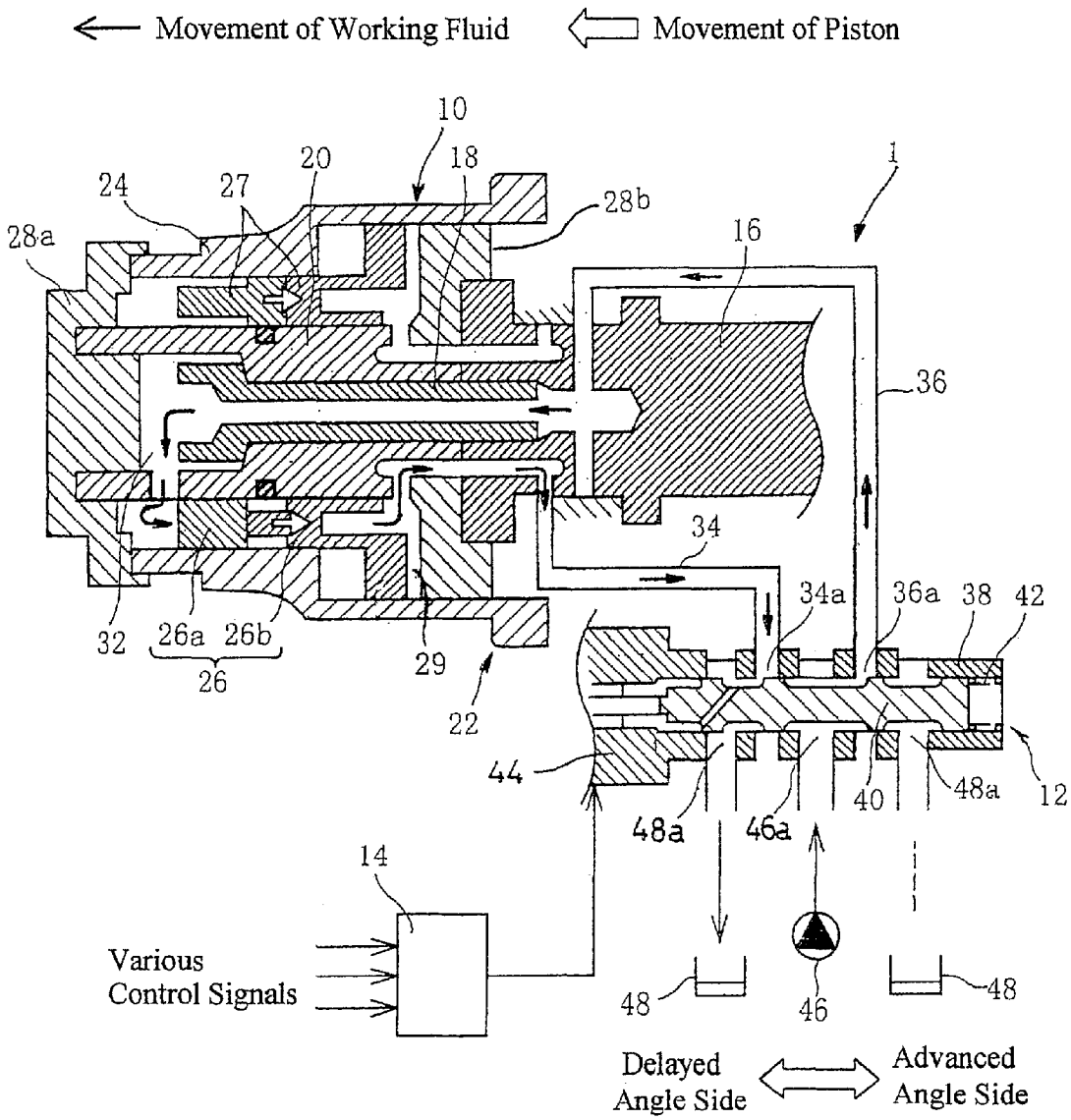
FIG. 2 a cross sectional view in accordance with the aforementioned embodiment, corresponding to a state in which the spool is maintained at a farthest position from the initial position.
Figure 3:
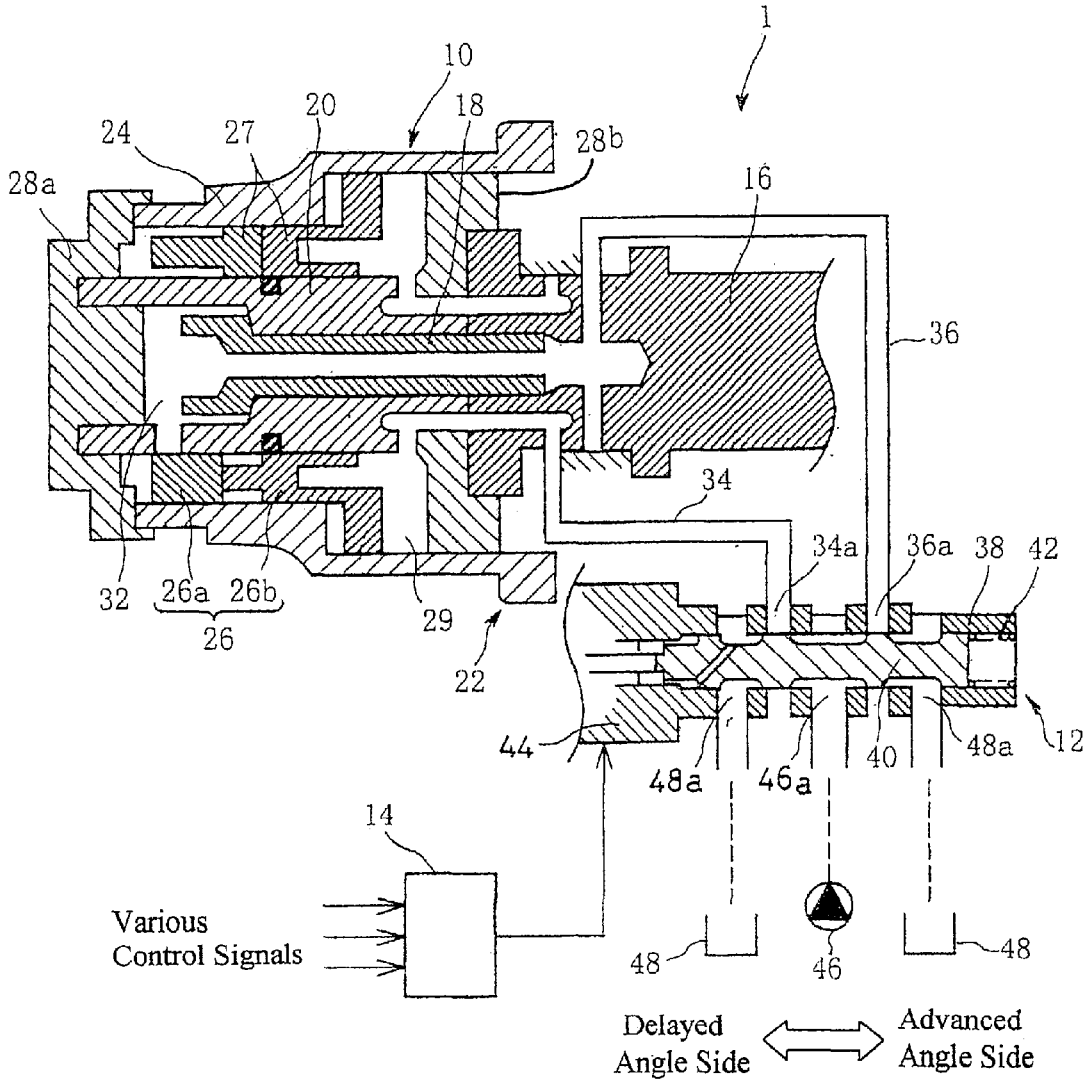
FIG. 3 a cross sectional view in accordance with the aforementioned embodiment, corresponding to a state in which the spool is maintained at an intermediate position.

Referring initially to FIGS. 1–3, a movable valve apparatus 1 for an internal combustion engine is illustrated to explain a first embodiment of the present invention. The movable valve apparatus 1 is illustrated as applied to an air intake valve of the internal combustion engine. Of course, it will be apparent to those skilled in the art from this disclosure that movable valve apparatus can be used with an air exhaust valve. Thus, the term "air control valve" as used herein refers to either an air intake valve or an air exhaust valve.

As seen in FIGS. 1–3, the movable valve apparatus 1 basically includes a movable valve mechanism 10, a hydraulic pressure control valve 12 and a controller 14. The movable valve mechanism 10 changes the opening/closing timing of an air intake valve (not shown in the Figures) in accordance with the hydraulic pressure of working fluid being supplied thereto. The hydraulic pressure control valve 12 adjusts the hydraulic pressure supplied to the movable valve mechanism 10. The controller 14 drives and controls the hydraulic pressure control valve 12. Thus, the controller 14 indirectly drives and controls the movable valve mechanism 10 as explained below in more detail.

The movable valve mechanism 10 is fixed to a front end of a camshaft 16 via a hollow bolt 18. The camshaft 16 drives the air intake valve in a conventional manner. The movable valve mechanism 10 basically includes an axle portion 20, an outer tubular portion 24, and a piston 26. The axle portion 20 rotates together with the camshaft 16. The outer tubular portion 24 is integrally formed on an inner peripheral side of a cam sprocket or a cam pulley 22. The cam sprocket or cam pulley 22 receives rotational power from the crankshaft (not shown) via a chain or a belt (not shown) in a conventional manner. The outer tubular portion 24 rotates in sync with the crankshaft. The piston 26 has a ring shape and meshes with an outer peripheral surface of the axle portion 20 and an inner peripheral surface of the outer tubular portion 24.

The piston 26 is preferably constructed as two members or parts 26*a* and 26*b* in order to prevent a backlash. The members 26*a* and 26*b* are biased in directions toward and away from each other by a spring not shown in the Figures. First and second helical splines are formed by the meshing portions 27 at the inner and outer peripheral surfaces of the piston 26, respectively. The first helical spline mates with a corresponding helical spline formed on an outer peripheral surface of the axle portion 20, while the second helical spline mates with a corresponding helical spline formed on an inner peripheral surface of the outer tubular portion 24.

On the rear side of the piston 26, a first hydraulic pressure chamber 29 is formed which shall be referred to as the "delayed angle chamber". On the front side of the piston 26, a second hydraulic pressure chamber 32 is formed which shall be referred to as the "advanced angle chamber". The delayed angle chamber 29 and the advanced angle chamber 32 are both basically defined by an inner peripheral surface of the outer tubular portion 24, the axial ends of the piston 26, and end covers 28*a* and 28*b*. As seen in FIGS. 1–3, the working fluid is supplied to the hydraulic pressure chamber 29 through a first fluid path 34 and to the hydraulic pressure chamber 32 through a second fluid path 36. The first and second fluid paths 34 and 36 are formed in inner portions of the camshaft 16 and the bolt 18.

The piston 26 moves in an axial direction (the left and right direction in FIGS. 1–3), in response to the hydraulic pressure in the hydraulic chambers 29 and 32. This axial movement of the piston 26 is converted into a relative rotational movement between the axle portion 20 and the outer tubular portion 24 via the aforementioned helical splines. Accordingly, the rotational phases of the members 20 and 24 change continuously. In this manner, a change in the rotational angle of the cam sprocket 22 changes the rotational angle of the camshaft 16 relative to the rotational angle of the cam sprocket, 22 changes. Therefore, the opening/closing timing (valve timing) of the air intake valve changes continuously.

Accordingly, this arrangement of the movable valve mechanism 10 is compact and easy to install in the engine. The movable valve mechanism 10 is also advantageous in that a low number of members or parts are utilized.

The hydraulic pressure control valve 12 selectively opens and closes the aforementioned first and second fluid paths 34 and 36, based on an ON-OFF drive (duty control) operated by a control signal from the controller 14. In this manner, the stopping position of the piston 26 is changed as needed and/or desired.

More specifically, the hydraulic pressure control valve 12 includes a tubular sleeve 38, a spool 40, a return spring 42, and a solenoid 44. The spool 40 reciprocates within the tubular sleeve 38. The return spring 42 functions as biasing means for biasing the spool 40 toward an initial position (left-hand side in the FIGS. 1–3). The solenoid 44 drives the spool 40 in response to a control signal from the controller 14, and moves the spool 40 in a direction away from the initial position against the urging force of the return spring 42.

The sleeve 38 has a plurality of ports formed therein. The ports are opened and closed depending on an axial position of the spool 40. In particular, the sleeve 38 includes a first port 34*a* that connects to the first fluid path 34, a second port 36*a* that connects to the second fluid path 36, a hydraulic pressure introduction port 46*a*, and a series of drain ports 48*a*. Working fluid is introduced into the hydraulic pressure introduction port 46*a* from a hydraulic pressure pump 46, which is a hydraulic pressure source. The series of drain ports 48*a* are connected to an oil pan 48 in a conventional manner.

When the solenoid 44 is in the stopping state, in other words, when the duty ratio of the ON-OFF signal outputted to the driving unit of the solenoid 44 is 0%, the spool 40 moves toward the initial position by the spring force (biasing force) of the return spring 42.

FIG. 1 shows a state in which the spool 40 is maintained in the initial position (solenoid stopping state). In this case, the first port 34*a* and the hydraulic pressure introduction port 46*a* are connected. Hydraulic pressure is supplied to the first hydraulic pressure chamber 29 through the first fluid path 34. In the meantime, the second port 36*a* and the drain port 48*a* are connected. Thus, working fluid in the second hydraulic pressure chamber 32 is drained through the second fluid path 36. This allows the piston 26 to move towards the left-hand side of FIG. 1. Accordingly, the camshaft 16 rotates to the delayed angle side relative to the cam sprocket 22 due to the movable valve mechanism 10.

In other words, in the state in which the spool 40 is in the initial position as shown in FIG. 1, the piston 26 moves to the initial position, which is on the far left-hand side in FIGS. 1–3. Accordingly, the opening/closing timing of the air intake valve is set to the most delayed angle side to achieve a delayed angle. Also, when the engine is stopped and the supplied hydraulic pressure is reduced, the camshaft 16 is maintained at the most delayed angle side, which is the initial state, due to a valve reactionary force that is applied to the camshaft 16.

When electric current (or electric voltage) supplied to the solenoid 44 is at a maximum level, in other words when the aforementioned duty ratio is 100%, the solenoid 44 drives the spool 40 in a direction away from the initial position (right-hand side in the FIGS. 1–3). FIG. 2 shows a state in which the spool 40 is at a position farthest from the initial position. In this case, the first port 34*a* and the drain port 48*a* are connected, such that working fluid in the first hydraulic chamber 29 is drained. In the meantime, the second port 36*a* and the hydraulic pump 46 are connected, such that hydraulic pressure is supplied to the second hydraulic pressure chamber 32. Therefore, the piston 26 is driven to the advanced angle side (right-hand side in the FIGS. 1–3).

Furthermore, when the supplied electric current (or electric voltage) to the solenoid 44 is at an intermediate level, in other words when the aforementioned duty level is about 50%, the spool 40 is maintained at an intermediate position as shown in FIG. 3. In this case, the spool 40 closes both the first port 34*a* and the second port 36*a*. In this manner, the hydraulic pressures in the first and second hydraulic pressure chambers 29 and 32 are maintained (locked). Accordingly, the piston 26 remains in its position.

In this manner, since the piston 26 can be moved to and maintained at any desired position, it is possible to set the opening/closing timing of the air intake valve to any desired opening/closing timing within a predetermined controlled range. Accordingly, it is possible to perform an improved control with more freedom.

The controller 14 is an engine control unit that preferably includes a microcomputer (CPU) and/or a memory device with a control program that drives and controls the spool 40 by outputting a control signal (duty signal) to the solenoid 44 of the hydraulic pressure control valve 12. The controller 14 can also include other conventional components such as an input interface circuit, an output interface circuit, and storage devices such as a ROM (Read Only Memory) device and a RAM (Random Access Memory) device. The controller 14 is operatively coupled to the solenoid 44 in a conventional manner. The spool 40 is driven and controlled in the manner described above, based on working conditions of the engine such as engine rotations, load, water temperature, and vehicle speed, which are detected by each sensor. The memory or CPU stores and processes various engine controls such as fail-safe, adjustment of igniting timing, fueling timing, and fuel supply amount, and over-supply adjustment.

It will be apparent to those skilled in the art from this disclosure that the precise structure and algorithms for the controller 14 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

Next, the structure and operation of the movable valve apparatus 1 of the present invention will now be explained referring to FIG. 4. As seen in part (c) of the graph shown in FIG. 4, the control target angle is a target value of the transmitted angle of the camshaft 16 relative to rotational angle of the crankshaft. Accordingly, the control target angle corresponds to a target value of the opening/closing timing of the air intake valve. Based on the working condition of the engine, this control target angle is sequentially determined by the controller 14.

Figure 4:
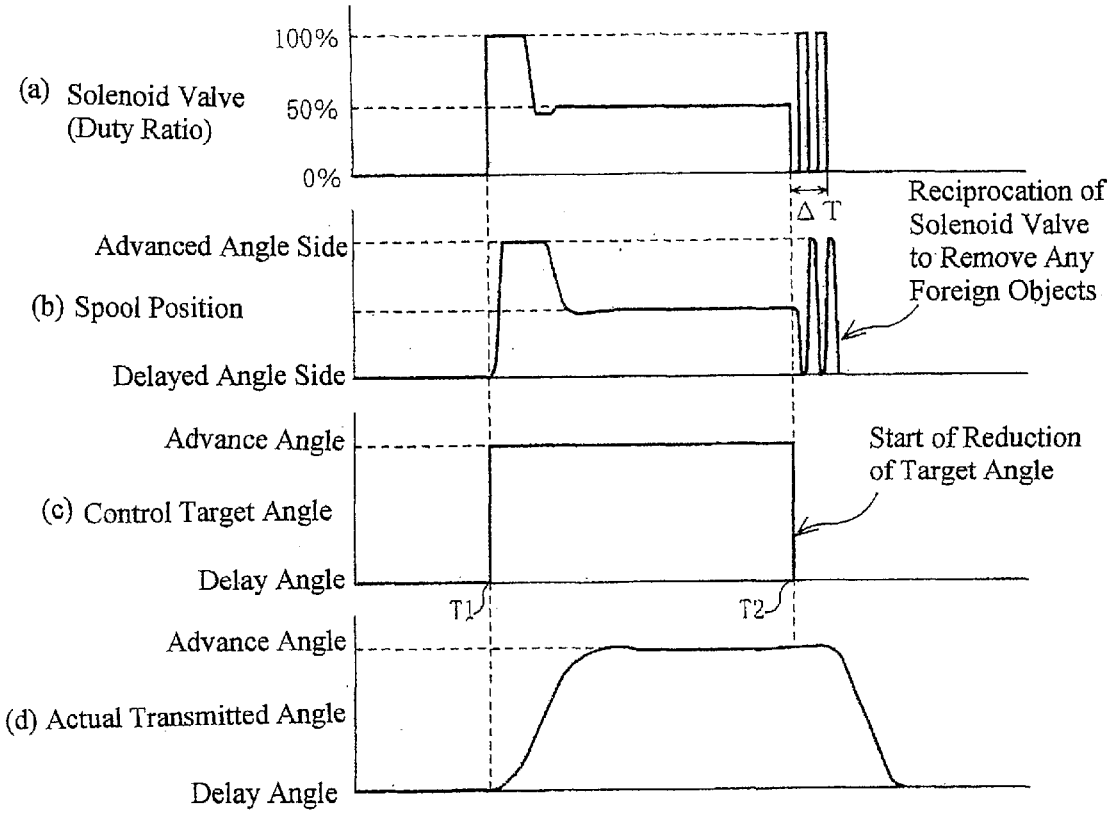
FIG. 4 a characteristics chart showing the flow of the control in accordance with the present embodiment.

When the target angle changes from the delayed angle side to the advanced angle side, (corresponding to the timing T1 in FIG. 4), the duty ratio is switched from 0% to 100% as seen in part (a) of the graph shown in FIG. 4. Accordingly, as seen in part (b) of the graph shown in FIG. 4, the spool 40 moves from the most delayed angle side, which is the initial position, to the advanced angle side. In this manner, the actual transmitted angle proceeds with some delay in response, as seen in part (d) of the graph shown in FIG. 4.

Once it is determined that this transmitted angle reaches the control target angle, the aforementioned duty ratio is switched to 50%. Accordingly, the spool 40 is maintained at the intermediate position as shown in FIG. 3. Therefore, the actual transmitted angle remains in the predetermined advanced angle state.

In this embodiment, when the, control target angle changes to the most delayed angle side from an advanced angle state (corresponding to the timing T2), it is determined based on this change in the target angle that the spool 40 is in the returning state, in which the spool 40 starts moving toward the initial position on the delayed angle side. Then, the foreign object removal operation is executed by making the spool 40 temporarily reciprocate in an axial direction to remove foreign objects from the hydraulic pressure control valve 12. In other words, the duty ratio is switched back and forth between 0% and 100% at a predetermined cycle during a predetermined period ΔT. This reciprocating cycle of the foreign object removal operation is set sufficiently shorter than the response time of the movable valve mechanism 10, such that the opening/closing timing of the air intake valve (actual transmitted angle) does not change inadvertently. For instance, the reciprocating cycle can be set as 10 Hz for 0.1 sec.

As seen above, in this embodiment, the foreign object removal operation is executed when it is determined that the spool 40 is in the returning state, in which the spool 40 starts moving toward the initial position on the delayed angle side. Therefore, precipitation, accumulation, and jamming of foreign objects within the hydraulic pressure control valve 12 are prevented. Accordingly, the jamming of foreign object at the time the spool 40 returns to the delayed angle side is prevented securely. Therefore, it is possible to avoid undesirable situations in which the opening/closing timing of the air intake, valve cannot return to the initial state on the delayed angle side because the spool 40 cannot return to its initial position due to such jamming of the foreign object. In other words, by using the present invention, it is possible to avoid problems such as the engine not starting properly, the engine not idling properly, or the engine stopping. In other words, by ensuring smooth and secure returning operation of the spool 40 to its initial position, it is possible to improve the stability of the engine.

If foreign object is jammed while the solenoid 44 drives and moves the spool 40 in a direction away from the initial position, the opening/closing timing of the air intake valve may not temporarily achieve the target value due to the jamming of the foreign object. However, the jamming of the foreign object can be automatically resolved when the spool 40 returns to the initial position due to the spring force of the return spring 42. Besides, the aforementioned foreign object removal operation is executed. Therefore, the spool 40 can surely return to the initial position.

Furthermore, by limiting the conditions under which the foreign object removal operation is executed to when the spool is in the returning state, it is possible to limit negative effects such as a decrease in responsiveness and an increase in power consumption that occur due to the execution of the foreign object removal operation to the minimum level.

Additionally, the foreign object removal operation is executed regardless of whether a foreign object is actually jammed. Therefore, there is no need to provide a sensor device for detecting jamming of a foreign object. Accordingly, it is possible to reduce the number of members, and simplify the apparatus.

Furthermore, since the returning state of the spool 40 is determined based on the decrease in the control target angle (change to the delayed angle side), there is no need for a separate sensor device to determine the returning state. Accordingly, it is possible to simplify the apparatus.

Alternatively, it is possible to execute the foreign object removal operation by determining that the spool 40 is in the returning state based on other means (triggers), not based on the change in the control target angle (target value) as in the above embodiment. In this case also, there is not need for a sensor device for determining the returning state. Therefore, it is possible to simplify the structure.

Figure 5:
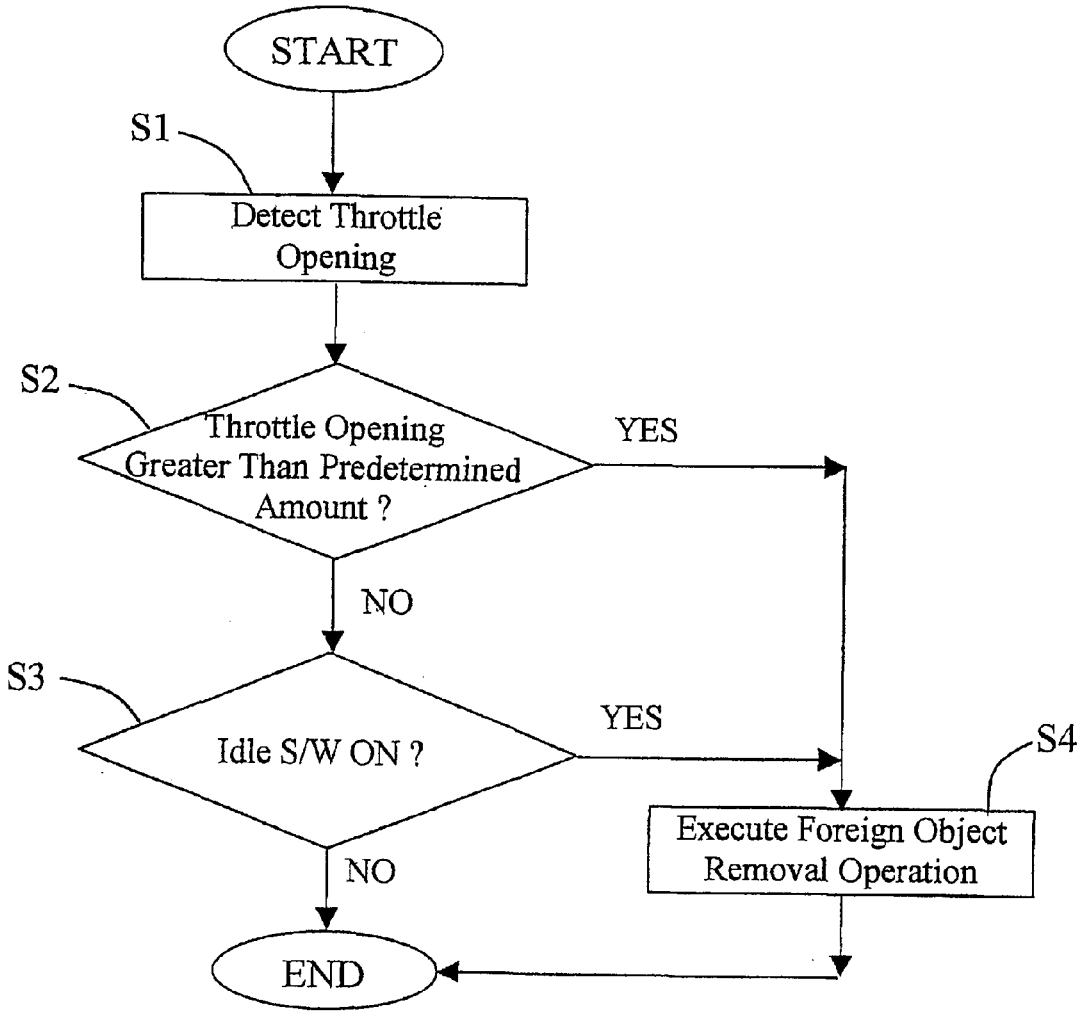
FIG. 5 a flowchart showing a flow of control where the returning state is determined based on a change in the throttle opening and a switch of idle switch.

As an example, FIG. 5 shows a flow chart of the control by the controller 14 in which the returning state is determined based on a change in the idle switch and a change in the throttle opening. First, in step S1, the throttle opening is detected. If the throttle opening decreases by more than a predetermined amount (step S2), or if the idle switch is switched from the OFF side to the ON side (step S3), the returning state is determined. Accordingly, the controller 14 proceeds to step S4, and executes the foreign object removal operation.

As another example, it is possible to execute the foreign object removal operation by determining that the spool 40 is in the returning state based on the slowing state of the engine as detected by a vehicle speed signal, or based on a change in the control signal to the solenoid 44 (change in duty ratio).

Furthermore, in the aforementioned embodiment, the movable valve mechanism 10 is of a type that changes the opening/closing timing (phase) of the air intake valve. Alternatively, the movable valve mechanism 10 can be of a type that switches between a plurality of cams having different valve lift amounts. In that case, it is configured such that a cam having a small valve lift amount is selected when the spool 40 of the hydraulic pressure control valve 12 is in the initial position.

As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The terms of degree such as "substantially", "about" and "approximately" as used herein mean a reasonable amount of deviation of the modified term such that the end result is not significantly changed. For example, these terms can be construed as including a deviation of at least +5% of the modified term if this deviation would not negate the meaning of the word it modifies.

This application claims priority to Japanese Patent Application No. 2000-220391. The entire disclosure of Japanese Patent Application No. 2000-220391 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. A movable valve apparatus for adjusting an air control valve of an internal combustion engine, comprising:

a movable valve mechanism operatively controlled by hydraulic pressure of a working fluid to adjusting the air control valve;

a hydraulic pressure control valve operatively coupled to the movable valve mechanism to adjust the hydraulic pressure of the working fluid supplied to the movable valve mechanism, the hydraulic pressure control valve includes a spool reciprocally coupled within a sleeve to control the hydraulic pressure of the working fluid supplied to the movable valve mechanism; and a controller operatively coupled to the hydraulic pressure control valve to drive and control the spool within the sleeve, the controller being configured to execute a foreign object removal operation upon the controller determining that the spool is in a returning state in which the spool starts moving toward an initial position, the spool being temporarily reciprocated by the controller to remove foreign objects inside the hydraulic pressure control valve during the foreign object removal operation.

2. The movable valve apparatus as set forth in claim 1, wherein the hydraulic pressure control valve includes biasing element that urges the spool toward the initial position, and a solenoid that drives the spool in a direction away from the initial position in response to a control signal from the controller.

3. The movable valve apparatus as set forth in claim 2, wherein the returning state is determined based on a change in the control signal to the solenoid.

4. The movable valve apparatus as set forth in claim 2, wherein the movable valve mechanism is arranged to change an opening/closing timing of the air control valve, and sufficiently shorter than a response time for adjustment of a working condition of the air control valve by the movable valve mechanism.

5. The movable valve apparatus as set forth in claim 4, wherein the controller is configured to set a target value of the opening/closing timing of the air control valve depending on a working condition of the engine, the returning state being determined by the controller based on a change of the target value toward the most delayed angle side.

6. The movable valve apparatus as set forth in claim 2, wherein the returning state is determined by the controller based on a slowing state of the engine.

7. The movable valve apparatus as set forth in claim 6, wherein the returning state is determined by the controller based on a decrease in a throttle opening or a switching of an idle switch from an OFF side to an ON side.

8. The movable valve apparatus as set forth in claim 2, wherein the controller has a predetermined reciprocating cycle that temporarily reciprocates the spool during the foreign object removal operation, and that is set sufficiently shorter than a response time for adjustment of a working condition of the air control valve by the movable valve mechanism.

9. The movable valve apparatus as set forth in claims 2, wherein the hydraulic pressure control valve is adjustable to maintain the movable valve mechanism at any position within a predetermined controlled range to adjust the air control valve.

10. The movable valve apparatus as set forth in claim 1, wherein the movable valve mechanism is arranged to change an opening/closing timing of the air control valve, and the initial position of the spool is set to a most delayed angle side so as to achieve a delayed angle of the opening/closing timing of the air control valve.

11. The movable valve apparatus as set forth in claim 10, wherein the controller is configured to set a target value of the opening/closing timing of the air control valve depending on a working condition of the engine, the returning state being determined by the controller based on a change of the target value toward the most delayed angle side.

12. The movable valve apparatus as set forth in claim 11, wherein the returning state is determined by the controller based on a decrease in a throttle opening or a switching of an idle switch from an OFF side to an ON side.

13. The movable valve apparatus as set forth in claim 1, wherein the returning state is determined by the controller based on a slowing state of the engine.

14. The movable valve apparatus as set forth in claim 1, wherein the controller has a predetermined reciprocating cycle that temporarily reciprocates the spool during the foreign object removal operation, and that is set sufficiently shorter than a response time for adjustment of a working condition of the air control valve by the movable valve mechanism.

15. The movable valve apparatus as set forth in claim 1, wherein the hydraulic pressure control valve is adjustable to maintain the movable valve mechanism at any position within a predetermined controlled range to adjust the air control valve.

16. A movable valve apparatus for adjusting an air control valve of an internal combustion engine, comprising:

hydraulic valve means for adjusting the air control valve;

regulating means for adjusting hydraulic pressure of a working fluid supplied to the hydraulic valve means; and control means for driving rind controlling the regulating means and for executing a foreign object removal operation upon the control means determining that the regulating means is in a returning state in which the regulating means starts moving toward an initial position, the regulating means being temporarily reciprocated by the control means to remove foreign objects inside the regulating means during the foreign object removal operation.

* * * * *